US006315578B1

(12) United States Patent
Kasai et al.

(10) Patent No.: US 6,315,578 B1
(45) Date of Patent: Nov. 13, 2001

(54) ELECTRICAL CONNECTION BOX, ITS METHOD OF MANUFACTURING, A WIRE CONNECTION BUSBAR OF AN ELECTRICAL CONNECTION BOX AND ITS PRODUCING METHOD

(75) Inventors: Koji Kasai; Kuniharu Kusumoto; Yukimitsu Harrori; Shigeru Kato; Akinori Oishi, all of Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/469,694

(22) Filed: Dec. 22, 1999

(30) Foreign Application Priority Data

Dec. 22, 1998 (JP) ..... 10-365583
Dec. 22, 1998 (JP) ..... 10-365585
Dec. 22, 1998 (JP) ..... 10-365586

(51) Int. Cl.[7] ..... H01R 12/00
(52) U.S. Cl. ..... 439/76.2; 439/404; 439/714
(58) Field of Search ..... 439/76.2, 714, 439/404, 418

(56) References Cited

U.S. PATENT DOCUMENTS 4,135,226 * 1/1979 Kourimsky ..... 361/415
4,537,455 * 8/1985 Vertenten et al. ..... 339/99
4,938,719 7/1990 Sawai et al. .
5,160,274 11/1992 Ozaki et al. .
5,207,591 5/1993 Ozaki et al. .
5,295,847 3/1994 Ozaki et al. .
5,322,445 6/1994 Ozaki et al. .
5,501,605 3/1996 Ozaki et al. .
5,626,492 5/1997 Onizuka et al. .
5,742,005 4/1998 Saka et al. .
5,778,528 7/1998 Saka et al. .
5,888,088 * 3/1999 Kobayashi et al. ..... 439/404
5,995,380 * 11/1999 Maue et al. ..... 361/826

FOREIGN PATENT DOCUMENTS 0 520 284 12/1992 (EP) .
09266018 10/1997 (JP) .
10023640 1/1998 (JP) .
10117420 5/1998 (JP) .

* cited by examiner

*Primary Examiner*—Paula Bradley
*Assistant Examiner*—Truc Nguyen
(74) *Attorney, Agent, or Firm*—Anthony J. Casella; Gerald E. Hespos

(57) ABSTRACT

Wires w-1, w-2 are laid along the inner surfaces of lower and upper casings 11, 12, and are connected with push-in terminals driven into connectors mounted in the lower and upper casings 11, 12. The ends of the wires in the upper and lower casings to be connected at the same lateral side of the casing have their insulating coatings stripped off to expose cores, which are connected with the upper and lower sides of U-shaped connection busbars 10 arranged on the side of the lower and upper casings.

10 Claims, 12 Drawing Sheets

ELECTRICAL CONNECTION BOX, ITS METHOD OF MANUFACTURING, A WIRE CONNECTION BUSBAR OF AN ELECTRICAL CONNECTION BOX AND ITS PRODUCING METHOD

BACKGROUND OF THE INVENTION

1. Field of the Invention

The present invention relates to an electrical connection box and to its method of manufacture. Furthermore, the present invention relates to a wire connection busbar of an electrical connection box and its production method.

2. Description of the Related Art

A prior art electrical connection box, such as a junction box, contains branch circuits at high density. Wires and push-in terminals may be used singularly or together with a busbar to form circuits in the prior art electrical connection boxes. To accommodate the high density of circuits, wires are laid along the inner surfaces of the lower and upper casings of the electrical connection box. The busbar then is arranged with insulating plates provided between the busbar and the wires in the lower and upper casings. In other words, circuits accommodated in the prior art electrical connection box have a layered construction of the wires, the busbar and more wires.

A prior art electrical connection box, as described above, is manufactured as shown in FIG. 16 by placing a lower casing 1 and an upper casing 2 side by side on the same plane and spaced apart by a specified clearance C, such that the respective inner surfaces face upwardly. Connectors 3 and 4 are fixed by jigs or like devices in predetermined positions on the upwardly facing inner surfaces of the lower and upper casings 1 and 2, and push-in terminals 5 are mounted into terminal mount holes of the connectors 3 and 4. Each terminal 5 has an upwardly facing slot formed with a blade. A strand of wire (single core wire) w is laid between the lower and upper casings 1 and 2 over the clearance C, i.e. from the lower casing 1 to the upper casing 2 and then back from the upper casing 2 to the lower casing 1, and so on along the inner surfaces of the side by side lower and upper casings 1 and 2. The wire w is pushed directly into the slots of the push-in terminals 5 mounted in the connectors 3 and 4 of the lower and upper casings 1 and 2, thereby connecting the wire w and the push-in terminals 5. The upper casing 2 then is turned onto the lower casing 1 as indicated by an arrow in FIG. 16. In particular, the upper casing 2 is fitted to the lower casing 1 in such a way that the wire w in the lower casing 1 faces the wire w in the upper casing 2.

The lower casing 1 to be fitted to the upper casing 2 may be constructed as shown in FIG. 17. Specifically, an insulating plate 6 is placed on a circuit formed by the wire w and the push-in terminals 5. A busbar 7 then is placed thereon, and an insulating plate 8 is further placed on the upper surface of the busbar 7. The lower casing 1 then is fitted to the upper casing 2 to arrange the wire w in the upper casing 2.

Since the wire w is laid with the lower and upper casings 1 and 2 placed on the same plane as described above, it should be laid over the clearance C defined between the lower and upper casings 1 and 2. If an attempt is made to fit the lower and upper casings 1 and 2 to each other in this state, a wire portion w-a extends over the clearance C between the lower and upper casings 1 and 2 and must be folded into a U-shape like a hinge as shown in FIG. 22. This wire portion w-a bulges outwardly and causes a problem.

The busbar 7 may have tabs 7*a* that project in positions near the side of the upper casing 2 toward the lower casing 1. In such a case, when the lower and upper casings 1 and 2 are rotated to each other, the tabs 7*a* of the busbar 7 may not align properly for insertion into specified mount holes formed in the upper casing 2.

The present invention was developed in view of the above problems, and an object thereof is to prevent a wire from bulging out from an outer surface at one side of a fitting portion of lower and upper casings and to solve a problem that tabs cannot be properly inserted into mount holes of the upper casing when the upper casing is fitted to the lower casing by being turned onto it.

SUMMARY OF THE INVENTION

According to the invention, there is provided an electrical connection box with a casing assembly comprised of first and second casings. A plurality of wires are laid along or on the inner surfaces of the casings. At least one connection busbar is mounted or mountable on at least one side surface of the first and second casings, such that the second and first wires are connected respectively to the second and the first ends of the connection busbar.

According to a further preferred embodiment, there is provided an electrical connection box with a casing assembly comprised of lower and upper casings. Wires are laid along the inner surfaces of the lower and upper casings and are to be connected with push-in terminals driven into connectors mounted in the lower and upper casings. Insulating coatings of the upper and lower wires to be connected at the same side end of the casing are stripped off to expose the wire cores. A U-shaped connection busbar is mounted on one side surface of the lower and upper casings such that the cores exposed at the ends of the upper and lower wires are welded to the upper and the lower ends of the connection busbar. Accordingly, the present invention preferably enables a variety of connection patterns of wires laid in the lower and upper casings.

The wires laid in the lower and upper casings are connected by the connection busbar that is arranged on the side surface of the casing, as described above. Thus it is not necessary to make the wires in the upper and lower casings continuous. Further, since the necessary wires in the lower and upper casings are connected by the connection busbar, a connection corresponding to a circuit design can be made easily and a design change can be dealt with easily. Furthermore, an electrical connection can be established with enhanced reliability since the connection busbar and the wire can be connected by welding.

The wires may be laid on the inner surfaces of the lower and upper casings by cutting a single strand of wire laid in the side by side lower and upper casings or by laying separate wires in the lower and upper casings. If the single strand of wire is laid in the side by side lower and upper casings, then a wire laying operation becomes easier. Further, since the wire is cut between the lower and upper casings, the above-described problems residing in the prior art can be solved. In particular these prior art problems relate to the fact that the folded portions, which serve as a hinge, bulge out of the casing, and the fact that it is difficult to insert the tabs into the terminal holes formed in the upper casing while the upper casing is turned onto the lower casing. On the other hand, the wire laying operation is even easier if the wires are separately laid in the lower and upper casings.

Preferably, a plurality of connection busbars are provided, and each of the connection busbars connects one or more wires in the lower casing with one or more wires in the upper casing. Specifically, the connection busbar may connect one wire in the lower casing with one wire in the upper casing (in this case, so-called "shorting pin"). If the strand of wire is cut after being laid in side by side casings and the cut ends of the wires in one casing are connected one on one with the corresponding cut ends of the wires in the other casing, the resulting circuit is the same as the one formed by the strand of wire before cutting.

Further, if two wires in the upper casing and one wire in the lower casing are connected by the connection busbar instead of constructing the same circuit as the one before cutting, two wires in the upper casing can be spliced (joined). Similarly, if two or more wires in the lower casing and two or more wires in the upper casing are connected by one connection busbar, a multitude of circuits can be joined.

Circuit construction can be changed easily, thereby improving an operability, if the wires in the respective casings are connected by the connection busbars arranged on the side of the casing, as described above.

According to a further preferred embodiment of the invention, there is provided an electrical connection box, wherein wires are laid along the inner surfaces of lower or first and upper or second casings. The wires are to be connected with bladed terminals driven into connectors that are mounted in the casings and are connected with each other by blades of a connection busbar arranged on the side surfaces of the casings.

The wires laid in the casings are connected by the connection busbar, as described above, and therefore need not be continuous. Further, the specified wires in the casings are connected by the connection busbars. This enables an easy connection in conformity with a circuit design and an easy response to a design change.

Cut ends of the wires may be bent upwardly in the lower casing and downwardly in the upper casing. Each connection busbar in this embodiment comprises a substantially vertical portion and upper and lower substantially horizontal portions that are bent at the opposite ends of the vertical portion. Connection slots formed by cutting the leading ends of the upper and lower horizontal portions are connected sideways with the upwardly and downwardly bent wires.

With the above arrangement, the wires in the upper and lower casings can be connected easily with the connection busbars by insulation displacement. As an alternative embodiment, each connection busbar may be in the form of a vertical plate instead of forming the upper and lower horizontal portions by bending. The upper and lower ends of the vertical plate may be cut to form slots, and each slot may have a blade. The wires are maintained horizontal and in that orientation are inserted into the slots for connection with the busbar.

According to a preferred embodiment, insulating coatings of the wires to be connected at the same side of the casing are stripped off to expose the wire cores. The exposed cores at the ends of the wires then are connected to the respective ends of the connection busbar. In this embodiment, each connection busbar may connect a desired number of the wires in the lower or first casing and a desired number of the wires in the upper or second casing by resistance welding, ultrasonic welding or laser welding. A cover made of an insulating resin then preferably is mounted on the connection busbar.

The circuits formed by the wires and the push-in terminals and a busbar circuit are used together by arranging the busbar between the circuits formed by the wires and the push-in terminals in the upper and lower circuits while providing the insulating plates on the opposite sides of the busbar. A plurality of busbars can be arranged while providing an insulating plate between the adjacent busbars, thereby arranging branch circuits at high density in the electrical connection box.

According to the invention, there is further provided a method for manufacturing an electrical connection box. The method comprises laying a plurality of wires on inner surfaces of first and second casings. The method proceeds by mounting at least one connection busbar on at least one side surface of the first and second casings such that the second and first wires are connected to the respective second and first ends of the connection busbar.

According to a preferred embodiment, the laying step further comprises a step of cutting a strand of wire laid between the side by side casings or individually laying wires in the respective casings.

According to the invention, there is further provided a wire connection busbar to be mounted on one surface of a casing of an electrical connection box. The electrical connection box, comprises a lower or first casing and an upper or second casing. The busbar connects wires laid horizontally on inner surfaces of the electrical connection box in two or more layers that are located one over another to construct internal circuits. The busbar comprises first or substantially vertical portions arranged at specified intervals, and connecting portions that connect intermediate portions of the first or vertical portions with respect to the vertical direction or the longitudinal direction of the first or vertical portions. The first or vertical portions and the connecting portions are formed by punching one electrically conductive plate. Specified connecting portions are cut in desired positions to divide the punched plate into a plurality of wire connection busbars, and each first or vertical portion comprises second portions or upper and lower horizontal portions, which preferably are bent at the upper and lower ends of the first or vertical portion in substantially the same direction for connection with the wires laid in the different layers.

Accordingly, a wire is prevented from bulging out from an outer surface at one side of a fitting portion of lower and upper casings. Additionally the wire connection busbar solves the problem that tabs cannot be inserted properly into mount holes of the prior art upper casing when the upper casing is fitted to the lower casing by being turned onto the lower casing. Moreover, there is enabled an efficient production of the wire connection busbar.

By dividing the wires of the internal circuits into different layers, as described above, no wire folding portion is formed when the electrical connection box is manufactured, and the lower and upper casings can be separated after the wires are laid. Accordingly, tabs projecting from the busbar can be inserted easily into their mount holes in the respective upper and lower casings. These wires in different layers need to be connected to construct the internal circuits. The internal circuits can be constructed easily by mounting the wire connection busbar on the side surface of the casing to connect the wires. This also enables an easy connection in conformity with a circuit design and an easy response to a circuit change.

The wire connection busbar can be fabricated easily at a low cost since it is formed by punching and bending one electrically conductive plate. Further, the wire connection busbar can cope with a variety of connection modes and circuit constructions having two or more layers by adapting the punched and bent shapes of the conductive plate to the divided state of the wires.

The wires of the internal circuits are laid along the respective inner surfaces of the lower and upper casings, and the cut ends thereof preferably are positioned at one side end of the casing to be connected with the upper and lower horizontal portions of the wire connection busbar. By positioning the cut ends at the side ends of the casing, a distance between the cut ends and the wire connection busbar mounted on the side surface of the casing can be made shorter. As a result, the wires and the wire connection busbar can be connected more easily.

The leading ends of the upper and the lower horizontal portions may be cut to form slots. Each slot is formed with at least one blade. The connection ends of the wires of the internal circuit in the upper layer are bent downwardly and the connection ends of the wires of the internal circuit in the lower layer are bent upwardly, thereby forming upper and lower bent portions to be inserted into the slots for connection. By forming the slots having the blades at the leading ends of the upper and lower horizontal portions of the wire connection busbar, the wire connection busbar can be connected more easily with the wires by insulation displacement. Further, the connection ends of the wires can be positioned better with respect to the bent blades.

Cores of the wires may be exposed by stripping their insulating coatings at the ends and the exposed cores may be connected with the upper and lower horizontal portions by welding and/or soldering. By connecting the wires and the wire connection busbar by welding and/or soldering instead of the connection established by insulation displacement, connection can be securely made within a short time. The welding methods include resistance welding, ultrasonic welding and soldering.

The invention further provides a method for producing a connection busbar for connecting wires laid in different layers in an electrical connection box. The method comprises punching an electrically conductive plate to form first or vertical portions arranged at specified intervals. The punching also forms connecting portions that connect intermediate portions of the first or vertical portions with respect to the vertical direction. The punching proceeds by bending the upper and lower sides of the respective vertical portions in the same direction to form (upper and lower) horizontal portions. The method then comprises removing a part of the first or vertical portions and connecting portions by cutting to divide the punched and bent plate into a plurality of wire connection busbars of specified shapes.

According to the above producing method, the wire connection busbar takes a basic configuration by punching and bending the conductive plate and then is divided into specified shapes by cutting so as to conform to a connection mode with the wires. Thus, the wire connection busbars can be mass-produced up to the process where they take their basic configuration. In a later process, the basic configuration is processed to cope with a variety of connection modes.

According to one preferred method, the leading ends of the (upper and lower) horizontal portions are cut to form slots, with each slot having a blade. By adopting this method, the produced wire connection busbar can be connected more easily with the wires by insulation displacement.

These and other objects, features and advantages of the present invention will become more apparent upon a reading of the following detailed description and accompanying drawings.

BRIEF DESCRIPTION OF THE DRAWINGS

FIGS. 15(A) and 15(B) show a wire connection busbar according to a further embodiment of the invention, wherein FIG. 15(A) is a development and a perspective view of the wire connection busbars corresponding to four layers of wires, and FIG. 15(B) is a development and perspective view of a modification.

DETAILED DESCRIPTION OF THE PREFERRED EMBODIMENTS

Figure 1:
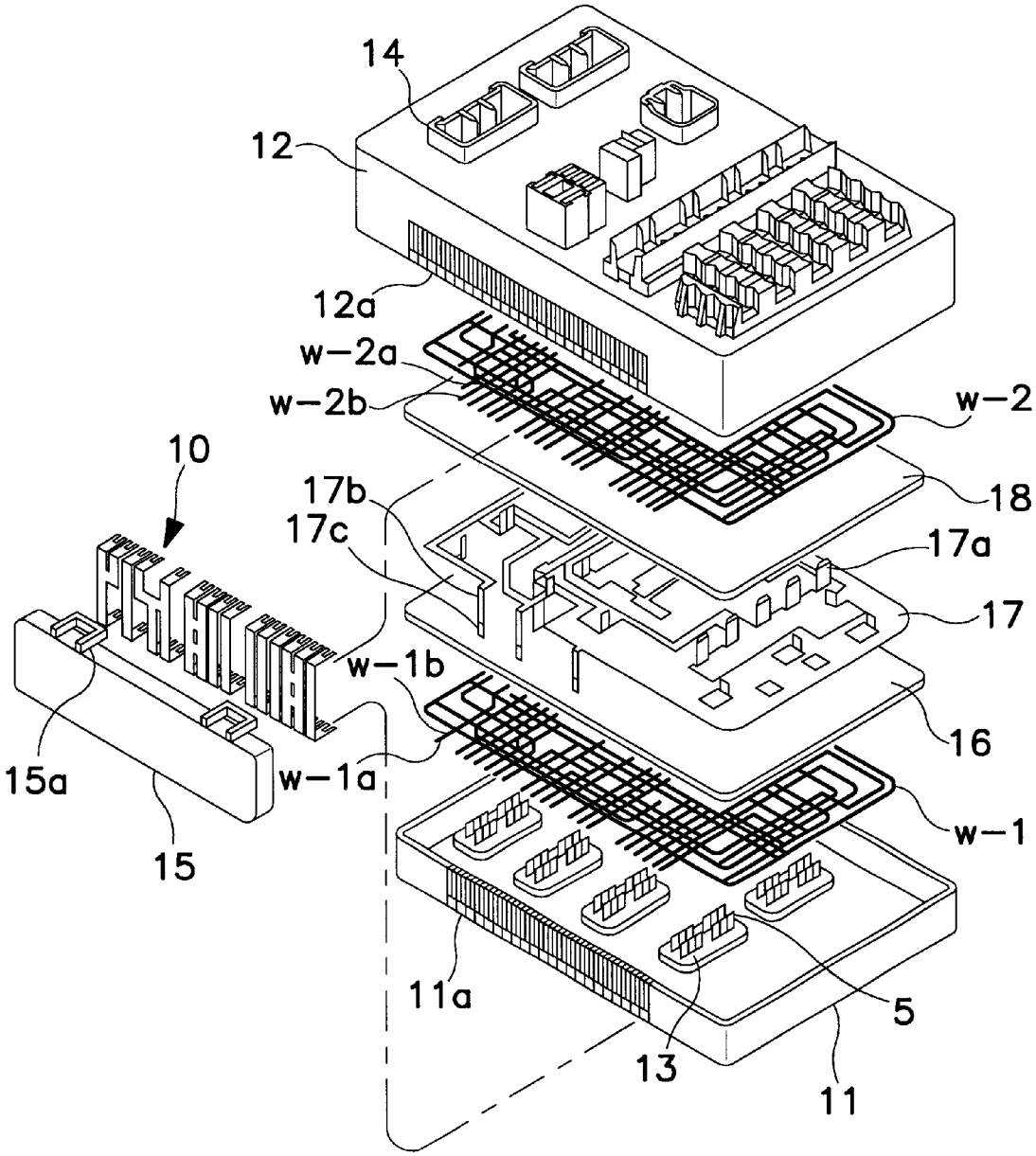
FIG. 1 is an exploded perspective view of an electrical connection box according to one embodiment of the invention.
Figure 2:
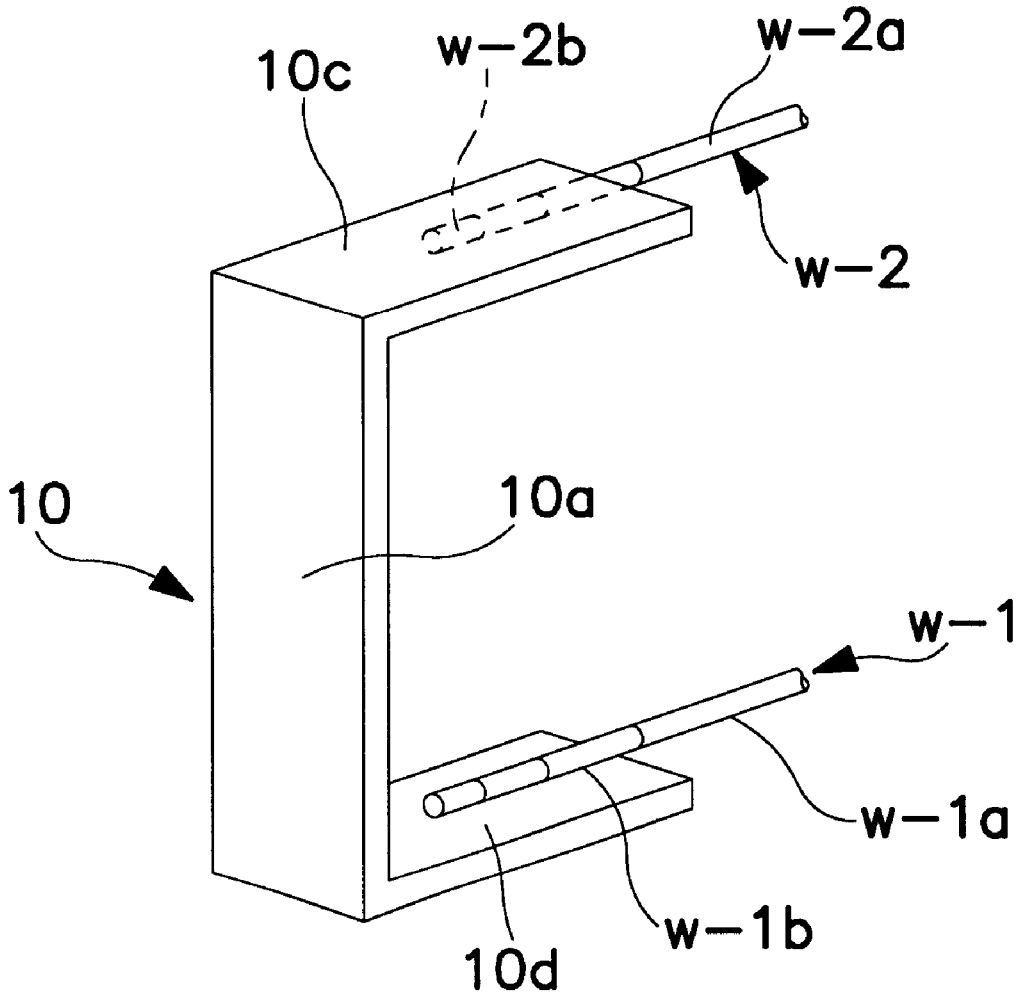
FIG. 2 is a perspective view showing a connection of wires in upper and lower layers of internal circuits of the electrical connection box with connection busbars on the side.

An electrical connection box according to the present invention is shown in FIG. 1, and is provided with a casing assembly having a lower casing 11 and an upper casing 12. An internal circuit is constructed by laying at least one wire (preferably a single core wire) w-1 in the lower casing 11 and at least one wire (preferably a single core wire) w-2 in the upper casing 12. An upper insulating plate 16, a busbar 17 and a lower insulating plate 18 are laid successively one over another between the wires w-1 and w-2. The wire w-2 and the wire w-1 in the different layers are connected or soldered or welded to each other by one or more connection busbars 10 that extend in substantially a vertical direction along one side surface of the casing, as shown in FIG. 2.

Figure 3A:
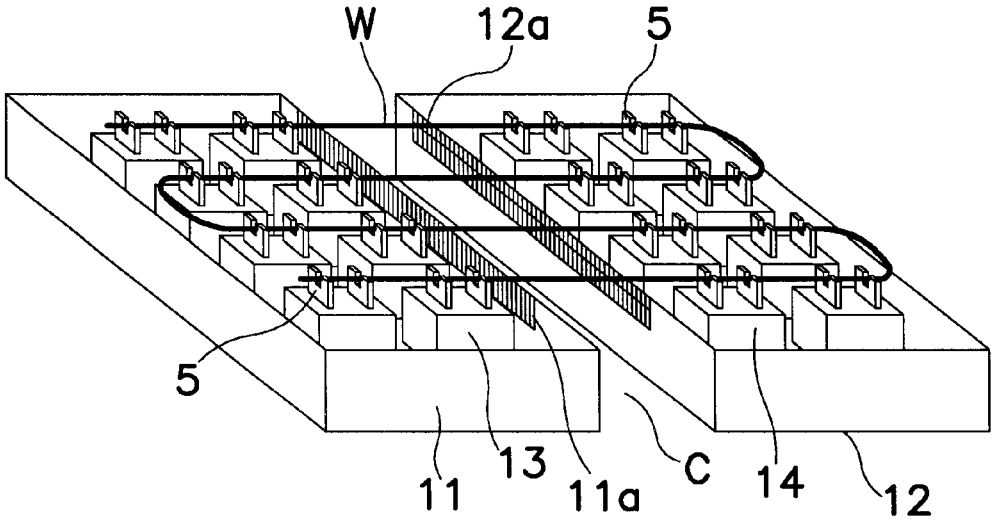
FIGS. 3(A) and 3(B) are perspective views showing a process of manufacturing the electrical box.

The electrical connection box is manufactured as shown in FIG. 3(A) by first placing the lower or first casing 11 and the upper or second casing 12 substantially side by side on substantially the same plane while being spaced apart by a clearance C. Push-in terminals 5 are driven into connectors 13 and 14, and the connectors 13 and 14 are fixed to the upper surfaces of the upwardly facing lower and upper casings 11 and 12, for example, by welding, gluing, clamping or the like. A strand of wire (single core wire) w then is laid across the upwardly facing surfaces of the casings 11 and 12 and over the clearance C. The wire w then is pushed directly into slots of the push-in terminals 5 for connection therewith.

Figure 3B:
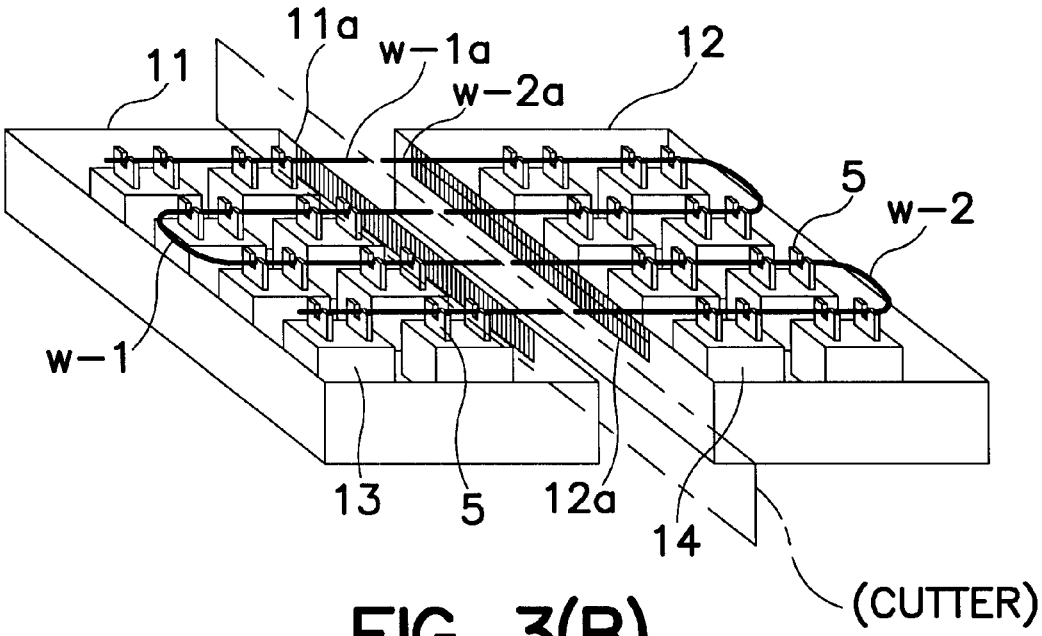

Next, wire portions w-a which extend over the clearance C and which could form hinge-like portions when the upper casing 12 is placed onto the lower casing 11 are cut in the middle as shown in FIG. 3(B). Accordingly, the strand of the wire w is; divided into the wires w-2 in the upper casing 12 and the wires w-1 in the lower casing 11. The wires w-1 and w-2 are not cut at the opposite sides as shown in FIG. 1.

The busbar 17 then is arranged such that the insulating plate 16 is provided between the busbar 17 and the wires w-1 of the lower casing 11, and such that the insulating plate 18 is provided between the busbar 17 and the wires w-2 of the upper casing 12. The busbar 17 is formed with tabs 17*a* which are to be inserted into mount holes formed in the lower casing 11 and/or the upper casing 12. Projecting portions 17*c* are formed on the busbar 17 and are provided with blade portions 17*b* to be connected with the wires w-2 and w-1 located in the upper and lower casings 12 and 11 respectively.

Portions of the wire w extending between the lower and the upper casing 11 and 12 are cut as described above. Hence the upper casing 12 need not be placed onto the lower casing 11 by being turned. Accordingly, the problem in the prior art of interference of the tabs 17*a* and the projecting portions 17*c* while the upper casing 12 is turned onto the lower casing 11, can be solved, and the tabs 17*a* of the busbar 17 can be precisely and smoothly inserted into the mount holes of the upper casing 12.

However, the wires w-1 of the lower casing 11 and wires w-2 of the upper casing 12, which are continuous in the prior art, need to be connected with each other in accordance with the subject invention.

Thus, cut end s w-1*a* and w-2*a* of the wires a re caused to project from one side surface of the casing while being spaced from each other along a vertical direction. The insulating coating at the cut ends w-1*a* and w-2*a* are stripped off to expose cores w-1*b* and w-2*b*. These exposed upper and lower cores w-1*b* and w-2*b* are welded or connected to each other by a plurality of connection busbars 10 (or shorting pins) arranged at the side, as shown in FIGS. 1 and 2.

Each connection busbar 10 has a first or vertical portion 10*a* and (upper and lower) second portions 10*c* and 10*d* extending at an angle different from 0° or 180°, preferably substantially at right angles from the opposite ends of the first or vertical portion 10*a*. The corresponding core w-2*b* of the wire w-2 is connected to the lower surface of the upper horizontal portion 10*c*, for example, by resistance welding. The corresponding core w-1*b* of the wire w-1 similarly is connected to the upper surface of the lower horizontal portion 10*d*, for example by resistance welding. Instead of resistance welding, ultrasonic welding or laser welding or soldering may be applied, provided that the cores can be connected to the connection busbars 10 e.g. by fusion. In this way, the cut wires are connected by the connection busbars 10.

Figure 4:
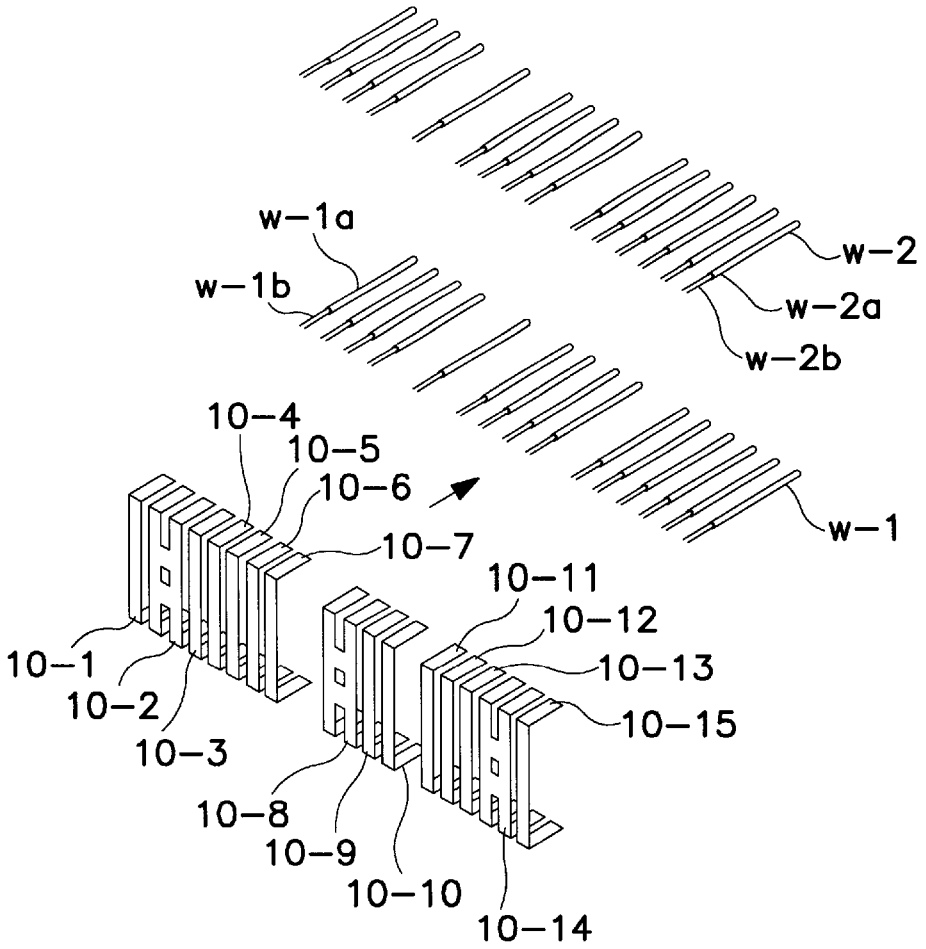
FIG. 4 is an exploded perspective view enlargedly showing an essential portion of the invention.

In this embodiment, there are provided first to fifteenth connection busbars 10-1 to 10-15, as shown in FIG. 4. The first to fifteenth connection busbars 10-1 to 10-15 are in different shapes. For example the busbar 10-1 and others are configured for connecting one wire in the upper casing 12 and one wire in the lower casing 11. Conversely the busbar 10-2 and others are configured for connecting two wires in the upper casing 12 and two wires in the lower casing 11. Further, the respective vertical portions are spaced apart by specified intervals.

By connecting the cut wires w-1 of the lower casing 11 and the cut wires w-2 of the upper casing 12 via the connection busbars 10 and changing the shapes of the connection busbars 10 as described above, a variety of circuit constructions can be created. In other words, a joint function may be provided by connecting a plurality of cut wires by one connection busbar.

As described above, the electrical connection box is assembled by placing the insulating plates 16, the busbar 17 and the insulating plate 18 one over another on the wires w-1 laid on the inner surface of the lower casing 11. Assembly proceeds by fitting the upper casing 12, in which the wires w-2 are laid, to the lower casing 11. The outer surfaces of the side walls of the lower casing 11 and upper casing 12 at the cut side are provided with side by side guide locks 11*a* and 12*a* for individually drawing the cut ends w-1*a* and w-2*a* out and locking the connection busbars 10, as shown in FIG. 1. The cut ends w-1*a* are drawn through the respective grooves of the guide lock 11*a* of the lower casing 11, whereas the cut ends w-2*a* are drawn through the respective grooves of the guide lock 12*a* of the upper casing 12. Alternatively, large openings may be formed in the side surfaces of the casings 11 and 12, and guide locking members, which can define grooves, may be fitted into the formed openings to individually draw the wires out and form the connection busbars one by one.

In this state, the cores w-1*b*, w-2*b* at the ends of the wires w-1 and w-2 are pressed against the opposed inner surfaces of the lower and upper horizontal portions 10*d*, 10*c* of the connection busbars 10-1 to 10-15 from the outside, and are connected therewith by resistance welding. Further, the blade portions 17*b* of the busbar 17 are connected with the wires w-1, w-2.

Figure 5:
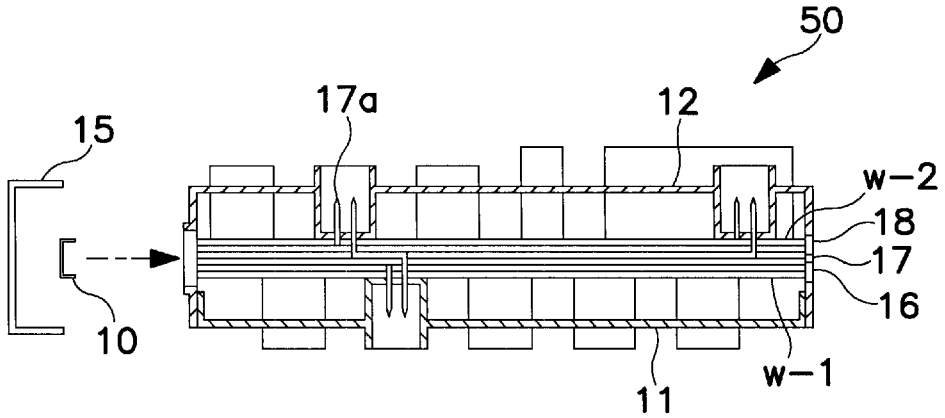
FIG. 5 is a section of the assembled electrical connection box of the embodiment.
Figure 6:
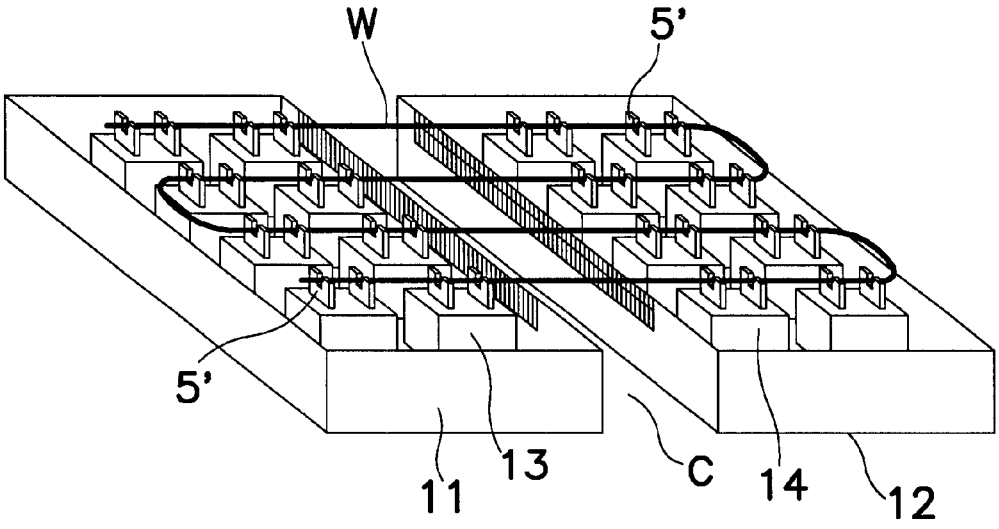
FIG. 6 is a perspective view showing one step of a production process of an electrical connection box according to a further embodiment of the invention.
Figure 7:
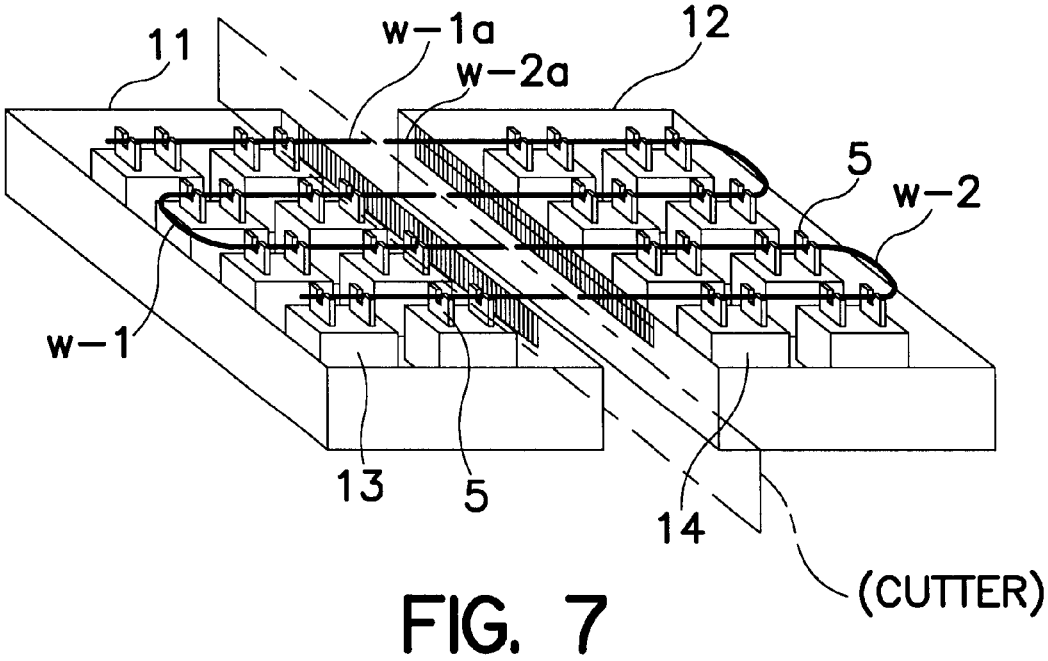
FIG. 7 is a perspective view showing another step according to an embodiment of the invention.

As described above, after the connection busbars 10 and the wires are welded, a cover 15, which preferably is made of an insulating resin, is mounted sideways for protecting and insulating the connection busbars 10. The cover 15 is mounted by engaging locking frames 15*a* provided on the upper and lower surfaces of the cover 15 and locking claws (not shown) formed on the lower or first and upper or second casings 11 and 12. The electrical connection box 50 thus assembled is as shown in FIG. 5.

In the electrical connection box 50 of the above construction, the wires do not bulge out from the side surface of the electrical connection box 50 as in the prior art, and the cut wires in the lower casing 11 and the upper casing 12 are connected by the mounted connection busbars 10. Further, the wires w-1 in the lower casing 11 and the wires w-2 in the upper casing 12 can be connected in a desired mode depending on the shape of the connection busbars 10, and a joint connection can be realized between the wires w-1 and w-2. In this way, this electrical connection box 50 can easily accommodate a change in circuit design.

In the foregoing embodiment, a strand of wire is continuously laid between the lower or first and upper or second casings that are placed substantially side by side. It should be noted that the wires w-1 and w-2 could be laid separately on the inner surfaces of the lower or first and upper or second casings 11 and 12, respectively.

In the case that wires are laid not only in the lower or first and upper or second casings but also on the insulating plates provided therebetween, the wires on the insulating plates may be welded to intermediate positions of the connection busbars mounted on the side so as to connect the wires arranged in a plurality of layers by the connection busbar on the side.

Further embodiments of the invention are described with reference to FIGS. 6 to 12. These embodiments are similar to the embodiments described and illustrated above, and the assembly of the illustrated parts also is similar. For simplicity, elements shown in FIGS. 6–12 that are substantially identical to elements of the first embodiment will not be described again, and merely will be identified by the same or similar numbers.

Figure 8:
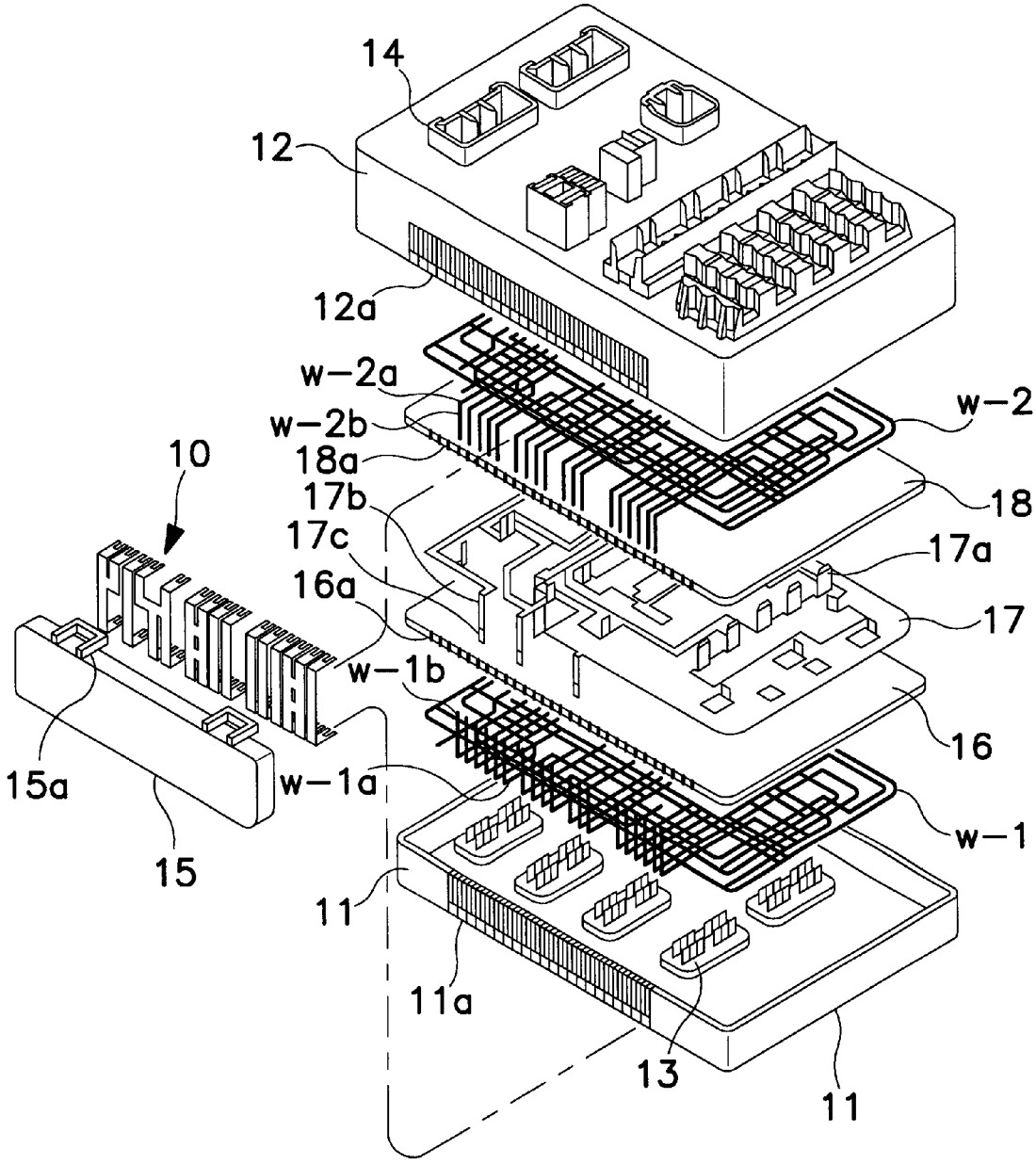
FIG. 8 is an exploded perspective view of the electrical connection box according to an embodiment of the invention.

One difference between the embodiments relates to the cut ends w-1*a* and 1-2*a* of the wires w-1 and w-2. In this embodiment, the cut ends w-1*a* of the wires w-1 in the lower casing 11 are bent substantially upwardly and the cut ends w-2*a* of the wires w-2 in the upper casing 12 are bent substantially downward as shown in FIGS. 8 and 9, thereby forming upper and lower bent portions w-1*b* and w-2*b*.

The upper and lower bent portions w-1*b* and w-2*b* are bent to face each other substantially vertically and are connected by a plurality of the connection busbars 10 (or shorting pins) aligned on the side. As in the previous embodiment each connection busbar 10 includes a substantially vertical or first portion 10*a*. Upper and lower substantially horizontal or second portions 10*c* and 10*d* bent at an angle different from 0° or 180°, preferably substantially at right angles at the opposite ends of the vertical portion 10*a*. Unlike the previous embodiment, leading ends of the upper and lower horizontal portions 10*c* and 10*d* are cut to form slots 10*e* and 10*f*. Each slot 10*e* and 10*f* has a blade formed on its inner surface.

The downwardly extending bent portions w-2*b* in the upper casing 12 can be inserted into the slots 10*e* of the upper horizontal portions 10*c* and can be connected with the upper horizontal portions 10*c* by having their insulation coatings cut by the blades. Similarly, the upwardly extending bent portions w-l*b* in the lower casing 11 can be inserted into the slots 10*f* of the lower horizontal portions 10*d* and are connectable with the lower horizontal portions 10*d* by having their insulation coatings cut by the blades. In this way, the cut wires are connected with each other by the connection busbars 10 which displace the insulation coating of the wires as the wires are inserted into the slots of the upper and lower horizontal portions 10*c* and 10*d*.

Figure 9:
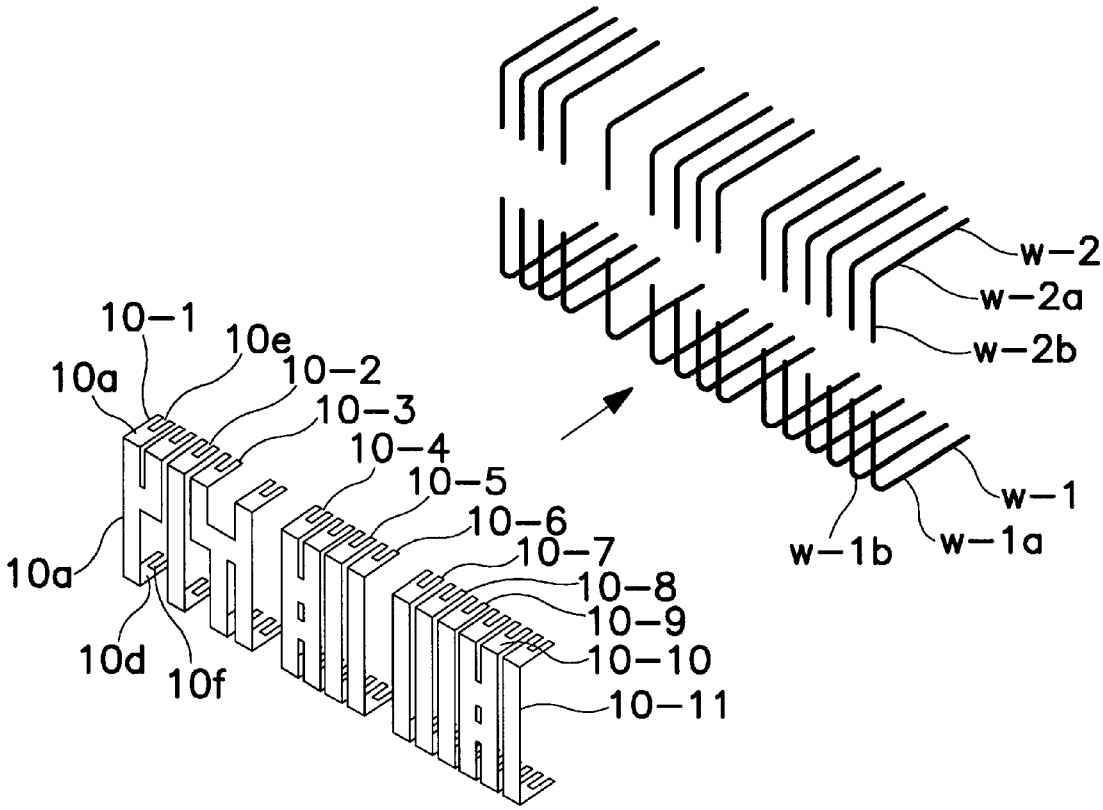
FIG. 9 is an enlarged exploded perspective view showing an essential portion of an embodiment of the invention.

In this embodiment, there are eleven connection busbars 10-1 to 10-11 as shown in FIG. 9. The 1st to 11th connection busbars 10-1 to 10-11 are in different forms. The busbars 10-2, 10-5, 10-6, 10-7, 10-8, 10-9, and 10-11 are adapted to connect one bent portion w-2*b* of the upper casing 12 with one bent portion w-1*b* of the lower casing 1. The busbar 10-1 is adapted to connect two bent portions w-2*b* of the upper casing 12 with one bent portion w-1*a* of the lower casing 11. The busbars 10-3, 10-4 and 10-10 are adapted to connect two bent portions w-2*b* of the upper casing 12 with two bent portions w-1*b* of the lower casing 11. These busbars are horizontally spaced apart by specified distances.

A variety of circuit constructions can be achieved by changing the shapes of the connection busbars and then connecting the cut wires w-1 and w-2 in the lower and upper casings 11 and 12 by the changed connection busbars 10. In other words, a joint function can be provided by connecting a plurality of cut wires by one connection busbar.

In this embodiment, the insulating plates 16 and 18 between the lower and upper casings 11 and 12 are formed with wire guide grooves 16*a* and 18*a* in their corresponding side edges. The cut ends w-1*a* are drawn through the grooves 11*a* of the lower casing 11 while the cut ends w-2*a* are drawn through the grooves 12*a* of the upper casing 12, and the bent portions w-1*b* and w-2*b* are positioned and held through the wire guide grooves 16*a* and 18*a* of the insulating plates 16 and 18.

In this state, the connection busbars 10-1 to 10-11 are pushed sideways so that the bent portions w-1*b* and w-2*b* of the wires w-1 and w-2 are pushed into the slots 10*f* and 10*e* of the lower and upper horizontal portions 10*d* and 10*c* for the connection. The blades 17*b* formed in the busbar 17 are also connected with the wires w-1 and w-2.

Figure 10:
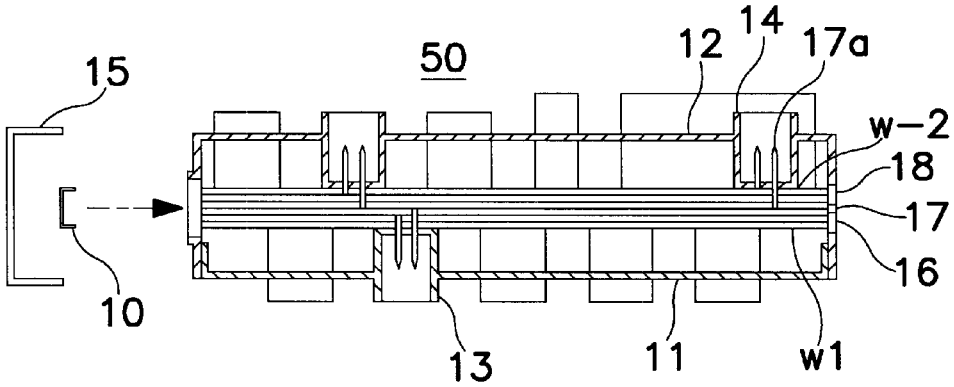
FIG. 10 is a section of the assembled electrical connection box according to the preceding embodiment.

As described above, a cover 15, which preferably is made of an insulating resin, is mounted sideways for the protection and insulation of the connection busbar 10 after the connection busbars and the wires are connected. This cover 15 is mounted by engaging locking frames 15*a* provided on the upper and lower surfaces thereof with locking claws (not shown) of the lower and upper casings 11 and 12. The electrical connection box 50 thus assembled is as shown in FIG. 10.

The electrical connection box 50 of the above construction differs from the prior art in that the wires do not bulge out from the side surface of the electrical connection box 50, and in that the cut wires in the lower casing 11 and the upper casing 12 are connected by the connection busbars 10. Further, the wires w-1 in the lower casing 11 and the wires w-2 in the upper casing 12 can be connected in a desired mode depending on the shape of the connection busbars 10, and a joint connection can be realized between the wires w-1 and w-2. In this way, this electrical connection box 50 can easily accommodate a change in circuit design.

Figure 11:
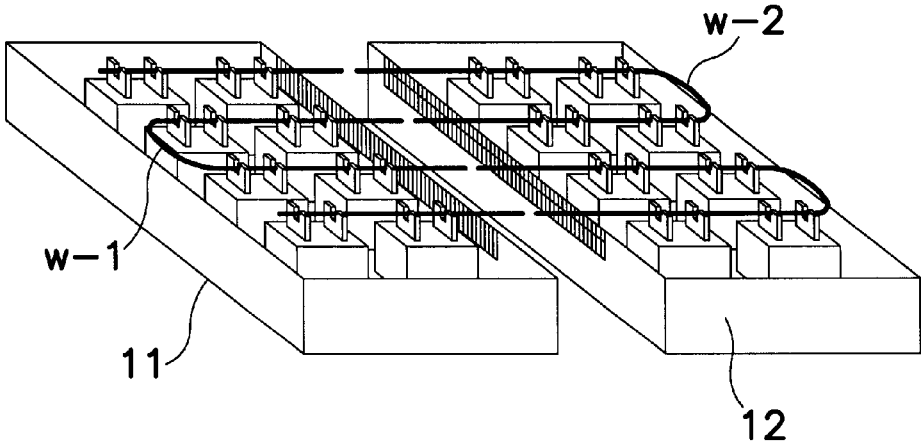
FIG. 11 is a schematic diagram showing another embodiment of the invention.

The present invention is not limited to the foregoing embodiment, but is also applicable to a case where wires w-1 and w-2 are laid separately in the lower and upper casings 11 and 12 as shown in FIG. 11. The wires w-1 in the lower casing 11 and the wires w-2 in the upper casing 12 can be connected in various manners by the connecting busbars 10 on the side.

Figure 12:
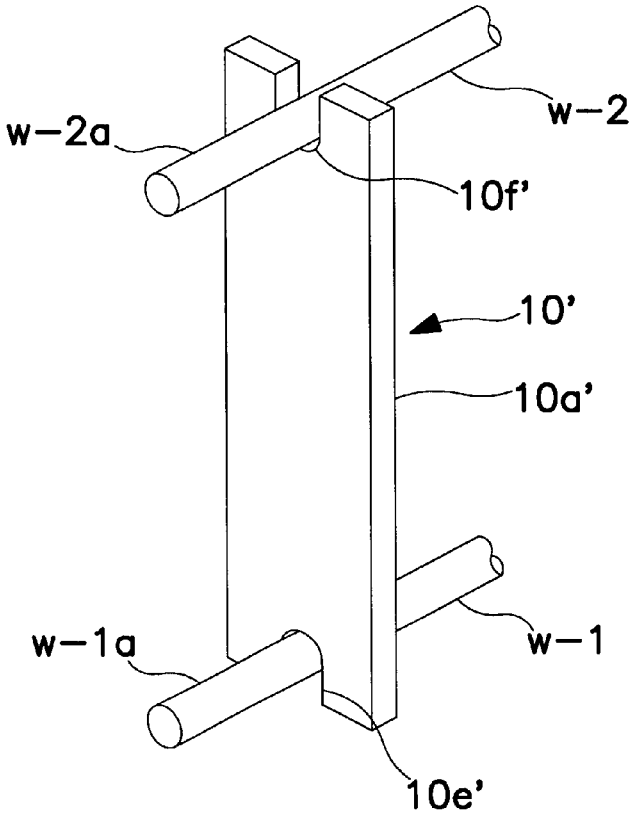
FIG. 12 is a schematic diagram showing a connection of an embodiment of the inventive connection busbar and wires by insulation displacement.

The shapes of the connection busbars 10 are not limited to those in the foregoing embodiment, either. As shown in FIG. 12, a connection busbar 10' has connection slots 10*e'* and 10*f'* opening upwardly and downwardly respectively at the upper and lower ends of a vertical portion 10*a'* without forming the horizontal portions. In such a case, the wire w-1 in the lower casing 11 and the wire w-2 in the upper casing 12 may be left horizontal without being bent, and may be inserted into the connection slots 10*e'* and 10*f'* for the connection.

The wires may be laid on the lower and upper casings, and also on the insulating plate provided therebetween. Those wires on the insulating plate may be connected with blades provided at intermediate positions of the connection busbars arranged on the side. In this way, the wires laid in a plurality of layers can be connected by insulation displacement by the connection busbars on the side.

Further aspects of the invention are described with reference to FIGS. 13–14(C).

Figure 13:
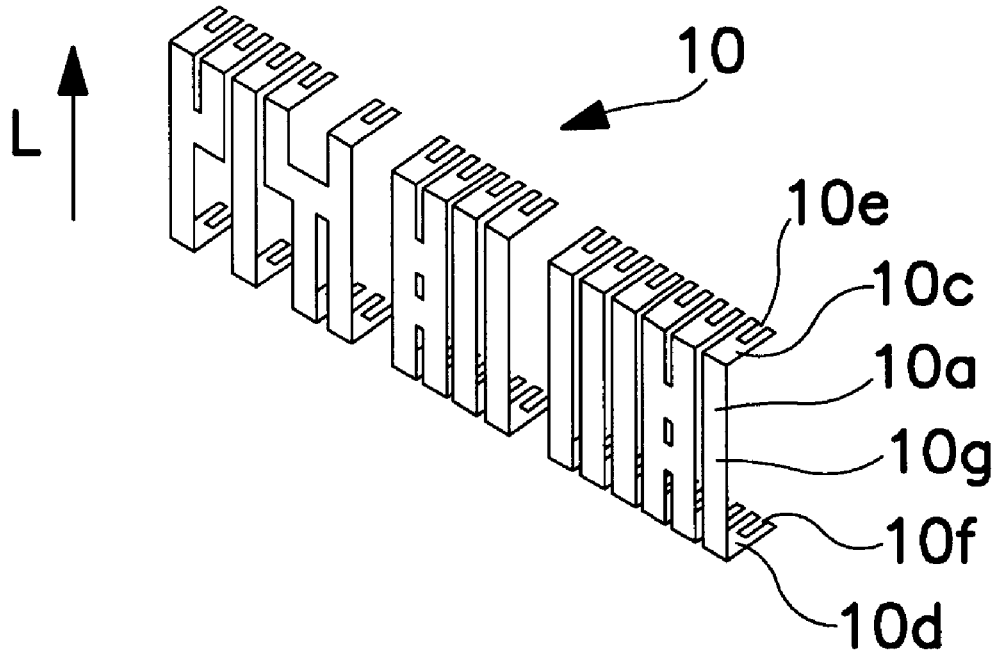
FIG. 13 is a perspective view of wire connection busbars according to yet another embodiment of the invention.

FIG. 13 shows a wire connection busbar 10 which is used in an electrical connection box. The busbar 10 preferably is formed by punching an electrically conductive plate to have a specified shape and bending the punched plate. This wire connection busbar 10 is adapted to connect wires laid in different upper and lower layers in the electrical connection box.

Figure 14A:
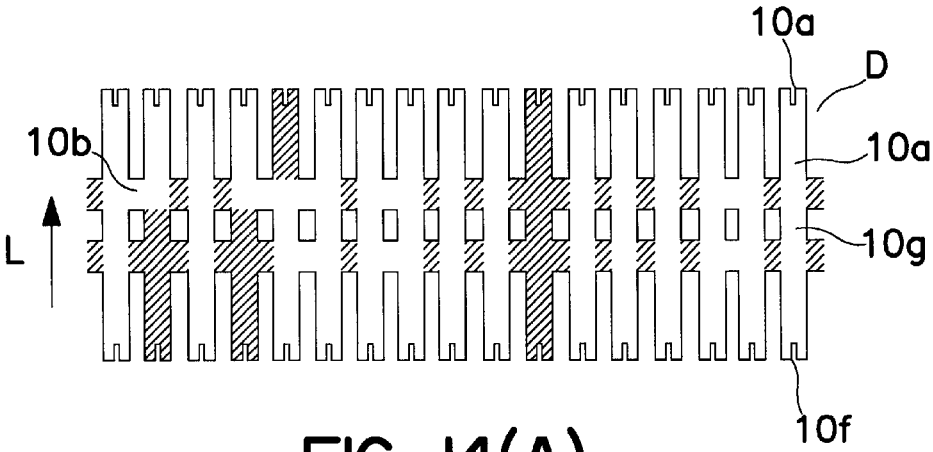
FIGS. 14(A), 14(B) and 14(C) are schematic diagrams showing a production process of the wire connection busbars.

A method for producing the wire connection busbar 10 is described with reference to FIGS. 14(A)–(C). As shown in FIG. 14(A), an electrically conductive plate D, which may be a brass plate or a copper alloy plate, is punched using a punching press to have a substantially H-shape. The H-shape refers to a shape comprised of vertical portions 10*a* spaced apart from each other by a specified distance and having a longitudinal direction L. Connecting portions 10*b* connect intermediate portions 10*g* of the adjacent vertical portions 10*a* with respect to the vertical direction or the longitudinal direction L. The punching process forms slots 10*e* and 10*f* at the upper and lower ends of the vertical portions 10*a*. Each slot 10*e* and 10*f* preferably has at least one blade. It should be noted that the slots 10*e* and 10*f* may be formed in a separate process.

Figure 14B:
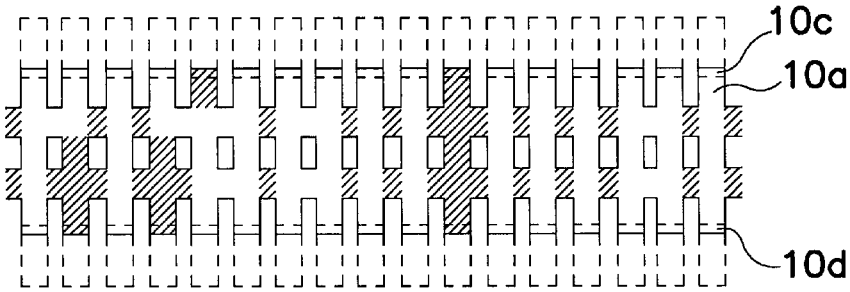
Figure 14C:
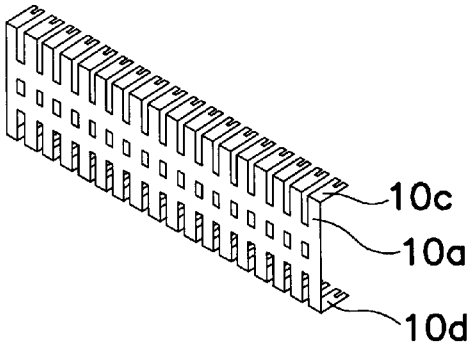

As shown in FIGS. 14(B) and 14(C), the upper and lower ends of the vertical portions 10*a* are bent at an angle different from 0° or 180°, and preferably substantially at right angles and in substantially the same direction by a bending apparatus to form upper and lower substantially horizontal portions 10*c* and 10*d* (second portions). Finally, portions of the vertical portions 10*a* and connecting portions 10*b* (hatched portions in FIGS. 14(A) and 14(B)) which are unnecessary for the connection with the wires or for the circuit construction are cut off using a cutting press, to form a plurality of wire connection busbars 10 as shown in FIG. 13. It should be noted that the order of the respective processes of the above producing method may be suitably changed in view of productivity and other factors. For example, the upper and lower horizontal portions may be formed after the unnecessary portions are cut off. The wire connection busbar 10 of FIGS. 13–14(C) are used in the electrical connection box as described and illustrated above.

Figure 15A:
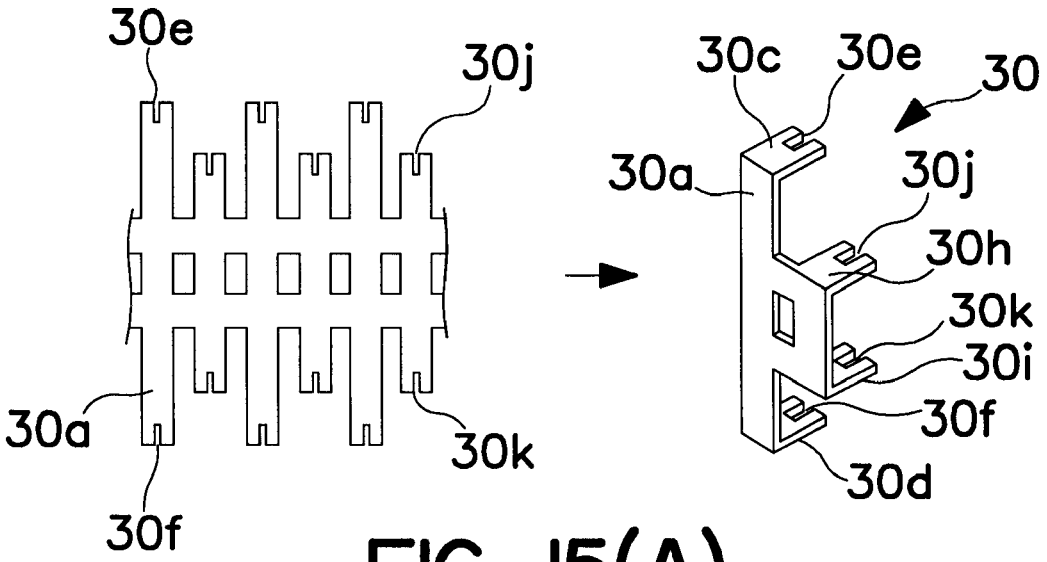

FIG. 15(A) shows still a further embodiment of the present invention with a wire connection busbar 30 that can be used with wires laid in four layers inside an electrical connection box. The wire connection busbar 30 includes second upper and lower horizontal portions 30*h* and 30*i* in addition to upper and lower horizontal portions 30*c* and 30*d*, and the leading ends of these horizontal portions are cut to form slots 30*e*, 30*f*, 30*j* and 30*k*, each of which has a blade.

The wire connection busbar 30 is formed by punching an electrically conductive plate into a shape of FIG. 15(A), bending specified portions of the punched plate, and cutting off unnecessary portions substantially in the same manner as in the previous embodiment(s). Four layers of the wires are arranged in the electrical connection box by alternately placing the wire layers and the insulating plates. A power supply busbar may be inserted into the above-described layered construction. The wires arranged as above are connected with the wire connection busbar 30 by the slots 30*e*, 30*f*, 30*j* and 30*k*. Alternatively, the wire connection busbar 30 may be connected with the wires e.g. by welding without forming the slots therein as in previously described embodiments.

Figure 15B:
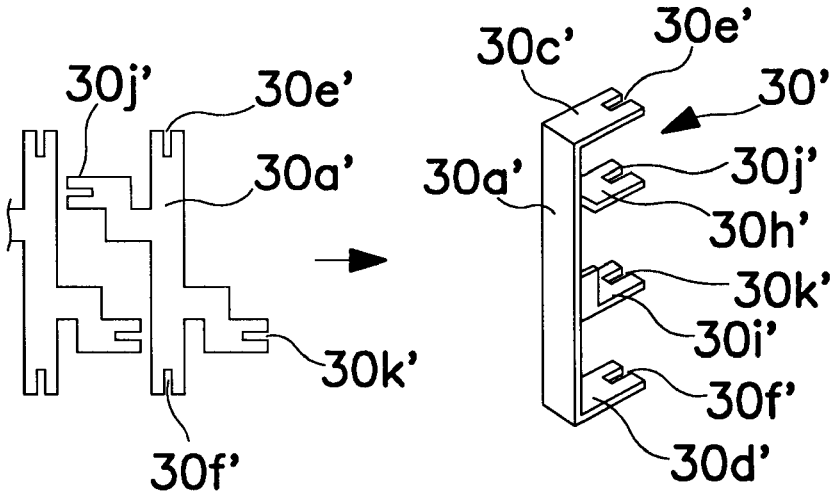
Figure 16:
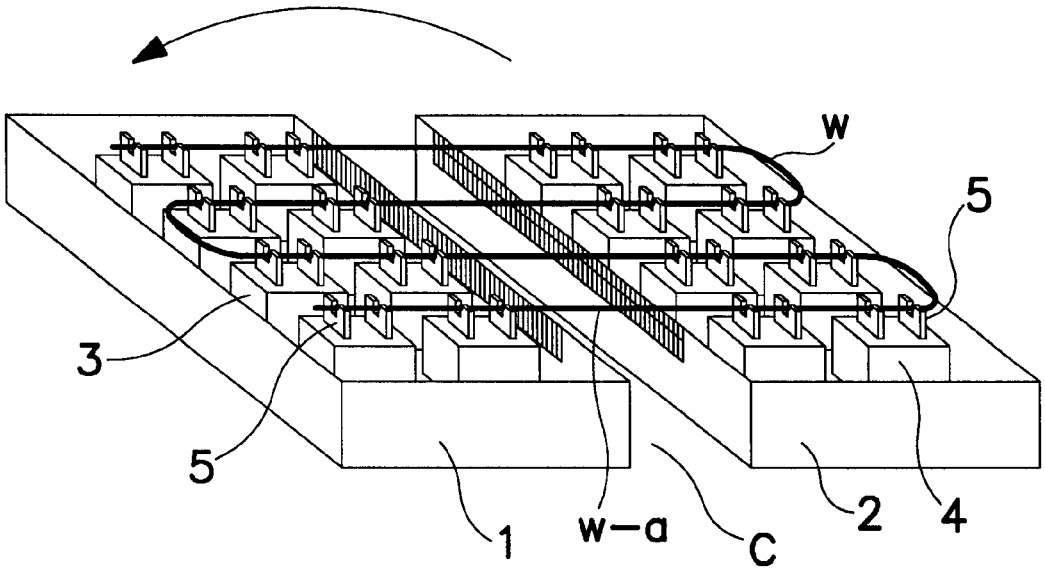
FIG. 16 PRIOR ART
FIG. 16 is a perspective view showing a prior art electrical connection box.
Figure 17:
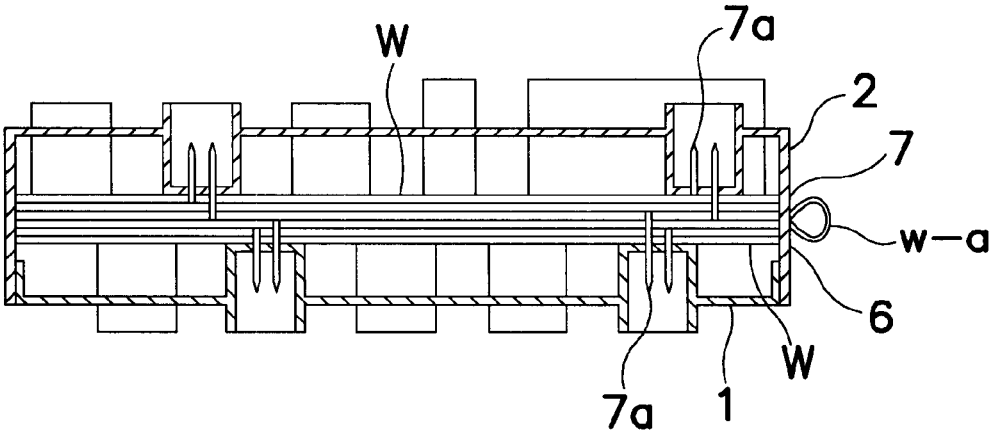
FIG. 17 PRIOR ART
FIG. 17 is a section of the prior art electrical connection box.

FIG. 15(B) shows a modification of the previous embodiment with a wire connection busbar 30' that is used with wires laid in four layers connected on a vertically extending straight line. This wire connection busbar 30' is produced and connected the wires in the same manner as in the third embodiment. The wire connection busbar can accommodate with the wires laid in three layers or those laid in five or more layers by suitably changing the punched shape and/or bent configuration.

As is clear from the above description, the wires laid along the inner surfaces of the casings are connected by the connection busbars according to the invention. Accordingly, one continuous strand of wire can be laid across the side by side casings, as in the prior art, but portions of the continuous strand between the casings can be cut. Alternatively, the wires can be laid separately in the casings, thereby making it easier to lay the wires. With either embodiments the invention avoids the problems of the prior art that the folded portions of the wire bulge out of the casing and that it is difficult to insert the tabs to be accommodated in the mount holes in the upper casing while the upper casing is turned onto the lower casing.

The plurality of wire connection busbars are provided, and each of them connects one or more wires in the lower casing with one or more wires in the upper casing. Accordingly, the circuits can be constructed easily using the wire connection busbar, and a circuit change can be easily dealt with. Connection by insulation displacement and connection by welding may be selected suitably in view of an operability and a connection reliability. Further, the wire connection busbars in the basic configuration can be produced efficiently by punching and bending. The wire connection busbars in the basic configuration easily can accommodate with a variety of connection modes.

What is claimed is:

1. An electrical connection box, comprising:

a casing assembly comprised of first and second casings having inner surfaces disposed in opposed relation to one another, and having side walls extending from said inner surfaces toward the other of said casings, at least one of said side walls in each said casing being formed with a plurality of grooves extending through the respective side wall, connectors mounted in the first and second casings, push-in terminals mounted in the connectors, a plurality of wires laid at least along the inner surfaces of the first and second casings and connected with the push-in terminals, the wires extending through the respective grooves to locations externally of said casing, a plurality of connection busbars mounted externally on the casing at the side walls of the first and second casings having the grooves, such that portions of the wires externally of the casing are connected to the connection busbar.

2. An electrical connection box according to claim 1, wherein the wires are laid on the inner surfaces of the first and second casings by cutting a single strand of wire laid in the first and second casings with the first and second casings placed substantially side by side.

3. An electrical connection box according to claim 2, wherein the wires are connected with each other by blades provided on the connection busbar.

4. An electrical connection box according to claim 3, wherein cut ends of the wires in each said casing are bent substantially toward the other of the casings, and wherein each connection busbar comprises a vertical portion and first and second horizontal portions bent at opposite ends of the vertical portion, connection slots being formed by cutting leading ends of the first and second horizontal portions and being connected sideways with the bent portions of the wires.

5. An electrical connection box according to claim 1, wherein insulating coatings of the wires adjacent the side surface of the casing are stripped off to expose cores at ends of the wires, the cores exposed at the ends of the wires being welded to the connection busbar.

6. An electrical connection box according to claim 1, wherein a cover made of an insulating resin is mounted on the casings to substantially cover the connection busbar.

7. An electrical connection box according to claim 1, further comprising at least one busbar arranged between the casings, a first insulating plate between the busbar and a first plurality of the wires disposed in the first casing and a second insulating plate between the busbar and a second plurality of the wires in the second casing.

8. A wire connection busbar to be mounted on an external surface of a casing of an electrical connection box, said electrical connection box being comprised of first and second casings for connecting, wires laid on inner surfaces of the first and second casings in at least two layers located one over another to construct internal circuits, portions of said wires extending externally of said casing at said external surface for connection with said busbar, said busbar comprising:

elongate planar portions arranged at specified intervals in at least one plane parallel to said external surface, each said elongate portion having an intermediate portion and opposite ends, and planar connecting portions connecting the intermediate portions of the elongate portions, wherein:

the elongate portions and the connecting portions are formed by punching one electrically conductive plate (D), specified ones of the connecting portions being cut in desired positions to divide the punched plates into a plurality of wire connection busbars, and each elongate portion comprising planar end portions extending from the ends of the elongate portion and being bent such that the planar end portions are perpendicular to plane of the elongate planar portions, said planar end portions being configured for connection with the wires at the external surface.

9. A wire connection busbar according to claim 8, wherein the end portions extending from the ends of the elongate portion all are bent in a common direction.

10. A wire connection busbar according to claim 8, wherein leading ends of the end portions are cut to form slots, each said slot being formed with a blade, and the wires being bent for forming first and second bent portions to be inserted into the slots.

* * * * *